US010465447B2

(12) United States Patent
Stockey et al.

(10) Patent No.: US 10,465,447 B2
(45) Date of Patent: Nov. 5, 2019

(54) CUTTING ELEMENTS CONFIGURED TO MITIGATE DIAMOND TABLE FAILURE, EARTH-BORING TOOLS INCLUDING SUCH CUTTING ELEMENTS, AND RELATED METHODS

(71) Applicant: Baker Hughes, a GE company, LLC, Houston, TX (US)

(72) Inventors: David A. Stockey, The Woodlands, TX (US); Suresh G. Patel, The Woodlands, TX (US); Alejandro Flores, Spring, TX (US); Konrad Izbinski, The Woodlands, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 608 days.

(21) Appl. No.: 14/656,036

(22) Filed: Mar. 12, 2015

(65) Prior Publication Data

US 2016/0265285 A1 Sep. 15, 2016

(51) Int. Cl.

| | |
|---|---|
| ***E21B 10/567*** | (2006.01) |
| ***E21B 10/55*** | (2006.01) |
| ***E21B 10/54*** | (2006.01) |

(52) U.S. Cl.

CPC ..... *E21B 10/5673* (2013.01); *E21B 10/567* (2013.01)

(58) Field of Classification Search

CPC ..... E21B 2010/545; E21B 10/55

See application file for complete search history.

(56) References Cited

U.S. PATENT DOCUMENTS 4,987,800 A 1/1991 Gasan et al.
4,989,578 A * 2/1991 Lebourg ..... B28D 5/00 125/23.01

(Continued)

FOREIGN PATENT DOCUMENTS

EP 0121083 A1 10/1984
EP 0572761 A1 12/1993

(Continued)

OTHER PUBLICATIONS

Patel et al., U.S. Appl. No. 14/480,293 entitled Multi-Chamfer Cutting Elements Having a Shaped Cutting Face, Earth-Boring Tools Including Such Cutting Elements, and Related Methods, filed Sep. 8, 2014.

(Continued)

*Primary Examiner* — David J Bagnell
*Assistant Examiner* — Manuel C Portocarrero
(74) *Attorney, Agent, or Firm* — TraskBritt

(57) ABSTRACT

A cutting element configured to mitigate spalling on a front cutting face thereof. The cutting element include a diamond table having the front cutting face defined thereon and at least one recess defined on the front cutting face of the diamond table. The at least one recess has a width within a range of 25.0 μm to 650 μm and a depth within a range of 25.0 μm to 600 μm. Methods of forming a cutting element configured to mitigate spalling on the front cutting face thereof. The methods including forming at least one recess on a front cutting face of a diamond table to have a width within a range of 25.0 μm to 650 μm and a depth within a range of 25.0 μm to 600 μm. Method of using a cutting element configured to mitigate spalling on the front cutting face thereof.

19 Claims, 7 Drawing Sheets

(56) References Cited

U.S. PATENT DOCUMENTS

| | | | | |
|---|---|---|---|---|
| 5,054,246 | A | 10/1991 | Phaal et al. | |
| 5,172,778 | A | 12/1992 | Tibbitts et al. | |
| 5,437,343 | A | 8/1995 | Cooley et al. | |
| 6,045,440 | A | 4/2000 | Johnson et al. | |
| 6,065,554 | A * | 5/2000 | Taylor | E21B 10/5673 175/430 |
| 6,196,340 | B1 | 3/2001 | Jensen et al. | |
| 6,244,365 | B1 | 6/2001 | Southland | |
| 6,510,910 | B2 | 1/2003 | Eyre et al. | |
| 6,527,069 | B1 | 3/2003 | Meiners et al. | |
| 6,550,556 | B2 | 4/2003 | Middlemiss et al. | |
| 6,672,406 | B2 | 1/2004 | Beuershausen | |
| 6,935,444 | B2 | 8/2005 | Lund et al. | |
| 7,475,744 | B2 | 1/2009 | Pope | |
| 7,726,420 | B2 | 6/2010 | Shen et al. | |
| 7,740,090 | B2 | 6/2010 | Shen et al. | |
| 8,037,951 | B2 | 10/2011 | Shen et al. | |
| 8,353,370 | B2 | 1/2013 | Bellin et al. | |
| 8,499,860 | B2 | 8/2013 | Shen et al. | |
| 8,684,112 | B2 | 4/2014 | DiGiovanni et al. | |
| 9,062,505 | B2 * | 6/2015 | Chapman | E21B 10/46 |
| 9,103,174 | B2 | 8/2015 | Digiovanni | |
| 9,145,743 | B2 | 9/2015 | Shen et al. | |
| 9,243,452 | B2 | 1/2016 | Digiovanni et al. | |
| 9,404,310 | B1 | 8/2016 | Sani et al. | |
| 9,428,966 | B2 | 8/2016 | Patel et al. | |
| 9,702,198 | B1 | 7/2017 | Topham | |
| 2006/0157286 | A1 | 7/2006 | Pope | |
| 2006/0219439 | A1 | 10/2006 | Shen et al. | |
| 2007/0079995 | A1 | 4/2007 | McClain et al. | |
| 2008/0205804 | A1 | 8/2008 | Jeng | |
| 2008/0236900 | A1 | 10/2008 | Cooley et al. | |
| 2009/0057031 | A1 | 3/2009 | Patel et al. | |
| 2010/0084198 | A1 | 4/2010 | Durairajan et al. | |
| 2010/0288564 | A1 | 11/2010 | Dovalina et al. | |
| 2011/0031031 | A1 * | 2/2011 | Vempati | C22C 26/00 175/428 |
| 2011/0088950 | A1 | 4/2011 | Scott et al. | |
| 2011/0155472 | A1 | 6/2011 | Lyons et al. | |
| 2011/0171414 | A1 | 7/2011 | Sreshta et al. | |
| 2011/0259642 | A1 | 10/2011 | Digiovanni et al. | |
| 2012/0247834 | A1 | 10/2012 | Buxbaum et al. | |
| 2012/0325563 | A1 | 12/2012 | Scott et al. | |
| 2013/0068534 | A1 | 3/2013 | DiGiovanni et al. | |
| 2013/0068537 | A1 | 3/2013 | DiGiovanni | |
| 2013/0068538 | A1 | 3/2013 | DiGiovanni et al. | |
| 2014/0041948 | A1 | 2/2014 | Shen et al. | |
| 2014/0238753 | A1 | 8/2014 | Nelms et al. | |
| 2014/0246253 | A1 | 9/2014 | Patel et al. | |
| 2015/0047913 | A1 | 2/2015 | Durairajan et al. | |
| 2015/0259988 | A1 | 9/2015 | Chen et al. | |
| 2016/0069140 | A1 | 3/2016 | Patel et al. | |
| 2016/0265285 | A1 | 9/2016 | Stockey et al. | |
| 2018/0320450 | A1 | 11/2018 | Borge et al. | |
| 2019/0071933 | A1 | 3/2019 | Gan et al. | |
| 2019/0084087 | A1 | 3/2019 | Chapman et al. | |

FOREIGN PATENT DOCUMENTS

| | | | |
|---|---|---|---|
| GB | 2369841 | | 12/2004 |
| JP | 11-060667 | A | 3/1999 |
| JP | 2008-291222 | A | 12/2008 |
| JP | 5315838 | B2 | 10/2013 |
| WO | 97/30263 | A1 | 8/1997 |
| WO | 00/48789 | A1 | 8/2000 |
| WO | 2004/007907 | A1 | 1/2004 |
| WO | 2004007901 | A1 | 1/2004 |
| WO | 2008/102324 | A1 | 8/2008 |
| WO | 2016/004136 | A1 | 3/2016 |

OTHER PUBLICATIONS

International Search Report from PCT International Application No. PCT/US2016/022020, dated Jun. 22, 2016, 3 pages.

International Written Opinion from PCT International Application No. PCT/US2016/022020, dated Jun. 22, 2016, 9 pages.

European Search Report and Search Opinion Received for EP Application No. 16762602, dated Oct. 15, 2018, 7 pages.

Chinese Office Action and Search Report for Chinese Application No. 201680015014.8, dated Oct. 8, 2018, 16 pages.

Korean Written Decision on Registration for Korean Application No. 10-2017-7027054, dated Jun. 19, 2018, 2 pages with English Translation.

Chinese Second Office Action for Chinese Application No. 201680015014, dated Jun. 25, 2019, 7 pages with English Translation.

* cited by examiner

CUTTING ELEMENTS CONFIGURED TO MITIGATE DIAMOND TABLE FAILURE, EARTH-BORING TOOLS INCLUDING SUCH CUTTING ELEMENTS, AND RELATED METHODS

TECHNICAL FIELD

Embodiments of the present disclosure relate to earth-boring tools, cutting elements comprising diamond tables for such earth-boring tools, and related methods.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit such as, for example, an earth-boring rotary drill bit. Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of the formation. Often various tools and components, including the drill bit, may be coupled together at the distal end of the drill string at the bottom of the wellbore being drilled. This assembly of tools and components is referred to in the art as a "bottom-hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

Spalls and cracks in the conventional polycrystalline diamond compact (PDC) cutting structures employed, for example, in fixed cutter and hybrid rotary drill bits and other drilling tools are a common problem when drilling with such cutting structures. Spalling in PDC tables of such cutting structures can greatly reduce the effectiveness of drill bits and other drilling tools and often renders a PDC table unusable such that the cutting structure including the PDC table must be completely replaced before the drill bit or other drilling tool is employed in another drilling operation.

BRIEF SUMMARY

This summary does not identify key features or essential features of the claimed subject matter, nor does it limit the scope of the claimed subject matter in any way.

Some embodiments of the present disclosure include a cutting element. The cutting element may include a diamond table having a front cutting face, the cutting face having an outer peripheral edge and at least one recess defined on the front cutting face of the diamond table. The at least one recess may include sidewalls intersecting with the front cutting face of the diamond table and extending to a base wall within the diamond table and wherein an intersection of a sidewall of the at least one recess and the front cutting face of the diamond table most proximate the outer peripheral edge of the front cutting face is located a distance of 0.5 mm to 4.0 mm from the outer peripheral edge of the front cutting face of the diamond table and wherein the at least one recess has a width within a range of 25.0 μm to 650 μm and a depth within a range of 25.0 μm to 600 μm.

Some embodiments of the present disclosure include an earth-boring tool including a bit body and at least one cutting element secured to the bit body. The cutting element may include a diamond table having a front cutting face, the cutting face having an outer peripheral edge and at least one recess defined on the front cutting face of the diamond table. The at least one recess may include sidewalls intersecting with the front cutting face of the diamond table and extending to a base wall within the diamond table and wherein an intersection of a sidewall of the at least one recess and the front cutting face of the diamond table most proximate the outer peripheral edge of the front cutting face is located a distance of 0.5 mm to 4.0 mm from the outer peripheral edge of the front cutting face of the diamond table and wherein the at least one recess has a width within a range of 25.0 μm to 650 μm and a depth within a range of 25.0 μm to 600 μm.

Some embodiments of the present disclosure include a method of reusing a cutting element configured to mitigate spalling. The method may include inserting a cutting element including a diamond table having at least one recess having a depth of 25.0 μm to 600 μm and a width of 25.0 μm to 650 μm defined on a front cutting face thereof into a pocket of an earth-boring tool. Then after performance of a drilling operation with the drill bit and after an occurrence of an initial spall in the diamond table of the cutting element, the cutting element may be rotated about a longitudinal axis thereof within the pocket to present an unspalled area of the front cutting face for drilling, and another drilling operation may be performed with the cutting element in the drill bit.

BRIEF DESCRIPTION OF THE DRAWINGS

While the specification concludes with claims particularly pointing out and distinctly claiming what are regarded as embodiments of the present disclosure, various features and advantages of this disclosure may be more readily ascertained from the following description of example embodiments of the disclosure provided with reference to the accompanying drawings.

DETAILED DESCRIPTION

Figure 1:
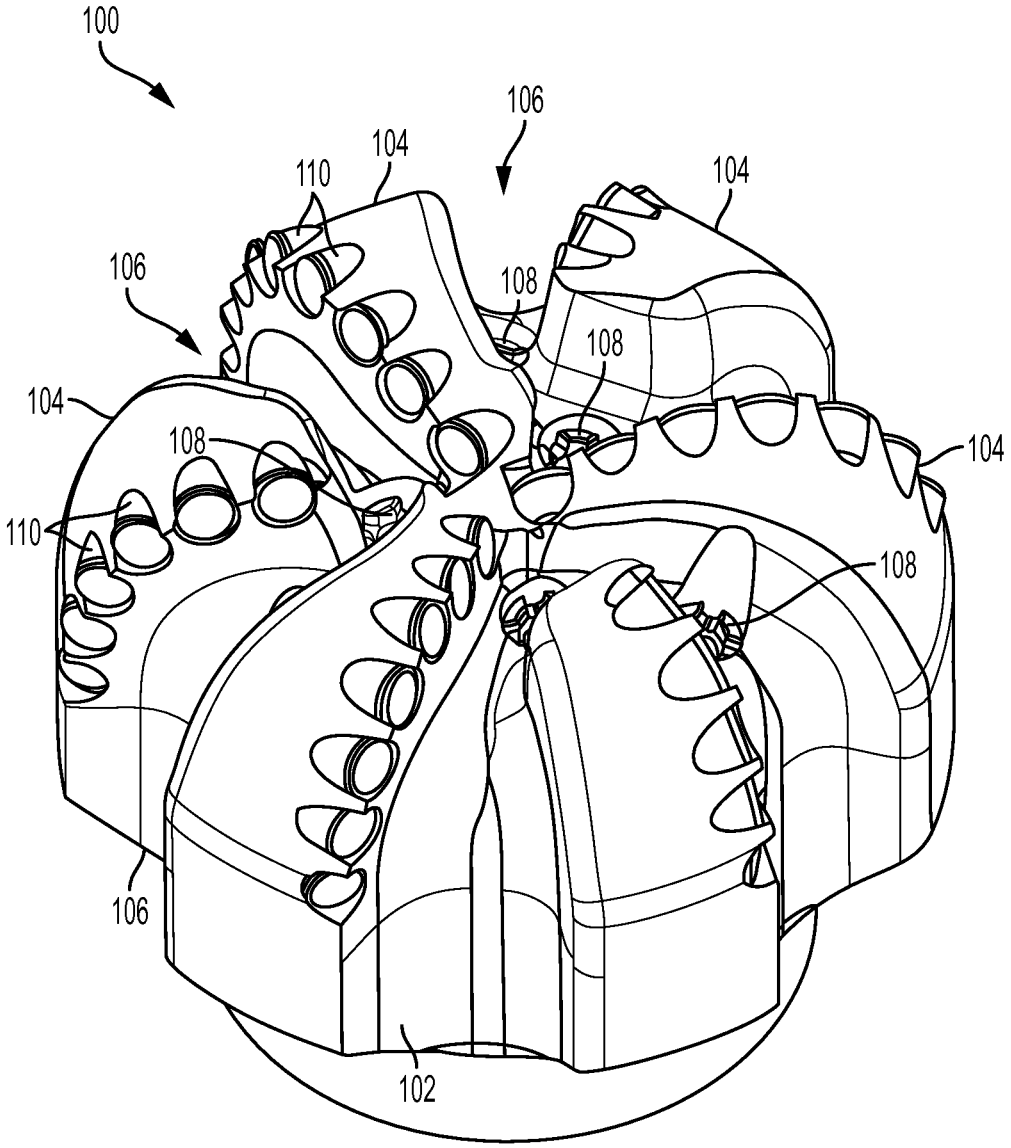
FIG. 1 is a perspective view of an earth-boring drill bit with blades carrying cutting elements, according to an embodiment of the present disclosure.

The illustrations presented herein are not actual views of any particular earth-boring tool, drill bit, cutting element, or component of such a tool or bit, but are merely idealized representations which are employed to describe embodiments of the present disclosure.

Embodiments of the present disclosure may include cutting elements having recesses defined in polycrystalline diamond compact (PDC) tables thereof that are configured to mitigate spalling and cracking in front cutting faces and lateral side surfaces (e.g., barrel faces) in the such diamond tables. For the sake of convenience, the term "diamond table" as used herein means and includes a polycrystalline diamond table comprising interbonded diamond grains formed in a high pressure, high temperature (HTHP) process, as is known to those of ordinary skill in the art. As used herein, the term "spall" means a fragment (e.g., chip, flake, piece, etc.) of a diamond table of a cutting element that is substantially two-dimensional (e.g., less than 60 μm thick) and that has broken off of the diamond table due to a fracture in the diamond table that occurs at least substantially parallel to the front cutting surface of the diamond table of the cutting element such that the spall may include at least a portion of the cutting surface of the diamond table. However, it is appreciated that, in some cases, a "spall" can be up to 1 mm thick. Accordingly, as used herein, the term "spalling" means spalls breaking off of the diamond table. Some embodiments include a plurality of recesses defined in a front cutting face of a diamond table of a cutting element. Some embodiments include a plurality of recesses defined in a lateral side surface of a diamond table of a cutting element. In some embodiments, the recesses help to mitigate spalling in the diamond table proximate the front cutting face and/or lateral side surface of the diamond table by tending to cause spalls to terminate at the recesses. In some embodiments, the recesses help to mitigate spalling in the front cutting face and lateral side surface of the diamond table by suppressing surface wave propagation across the front cutting face and lateral side surface of the diamond table. In some embodiments, the recesses may sufficiently mitigate spalling such that after an initial spall in the diamond table proximate the front cutting face or lateral side surface, the cutting element may be rotated (i.e., "spun") and re-used in a drilling operation.

As used herein, any relational term, such as "first," "second," "top," "bottom," "upper," "lower," "outer," "inner," is used for clarity and convenience in understanding the disclosure and accompanying drawings, and does not connote or depend on any specific preference, orientation, or order, except where the context clearly indicates otherwise. For example, these terms may refer to an orientation of elements of the apparatus relative to a surface upon which the apparatus may be disposed and operated (e.g., as illustrated in the figures).

As used herein, the term "earth-boring tool" means and includes any tool used to remove formation material and form or enlarge a bore (e.g., a wellbore) through one or more subterranean formations by way of removing formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools, etc.

As used herein, the term "cutting element" means and includes any element of an earth-boring tool that is used to cut or otherwise disintegrate formation material when the earth-boring tool is used to form or enlarge a bore in the formation.

FIG. 1 illustrates an embodiment of an earth-boring tool of the present disclosure. The earth-boring tool of FIG. 1 is a fixed-cutter rotary drill bit 100 having a bit body 102 that includes a plurality of blades 104 that project outwardly from the bit body 102 and are separated from one another by fluid courses 106. The portions of the fluid courses 106 that extend along the radial sides (the "gage" areas of the drill bit 100) are often referred to in the art as "junk slots." The bit body 102 further includes a generally cylindrical internal fluid plenum, and fluid passageways (not visible) that extend through the bit body 102 to an exterior surface of the bit body 102. Nozzles 108 may be secured within the fluid passageways proximate the exterior surface of the bit body 102 for controlling the hydraulics of the drill bit 100 during drilling. A plurality of cutting elements 110 is mounted to each of the blades 104.

During a drilling operation, the drill bit 100 may be coupled to a drill string (not shown). As the drill bit 100 is rotated within the wellbore, drilling fluid may be pumped down the drill string, through the internal fluid plenum and fluid passageways within the bit body 102 of the drill bit 100, and out from the drill bit 100 through the nozzles 108. Formation cuttings generated by the cutting elements 110 of the drill bit 100 may be carried with the drilling fluid through the fluid courses 106, around the drill bit 100, and back up the wellbore through the annular space within the wellbore outside the drill string.

Figure 2:
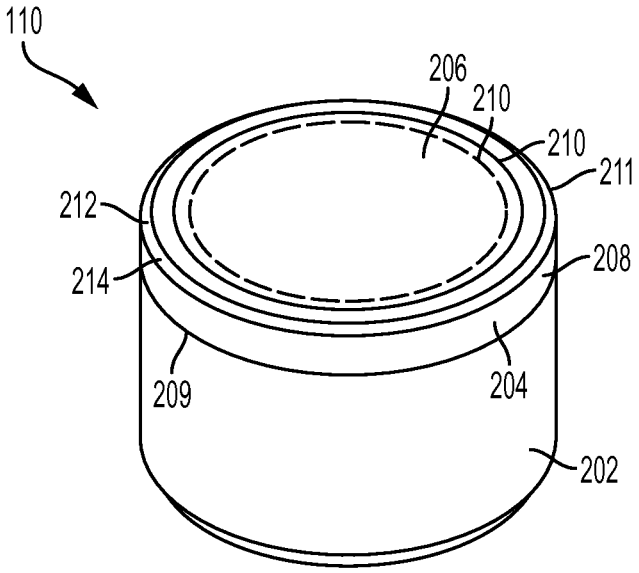
FIG. 2 is a perspective view of a cutting element including a front cutting face having a recess defined thereon, according to an embodiment of the present disclosure.

FIG. 2 is a perspective view of a cutting element 110 of the drill bit 100 of FIG. 1. The cutting element 110 may include a cutting element substrate 202 and a volume of superabrasive material, such as a diamond table 204. The diamond table 204 may include a front cutting face 206, a lateral side surface 208, and at least one recess 210 (e.g., disruption, groove, engraving, channel, etc.) defined in the front cutting face 206. The diamond table 204 may be disposed on the cutting element substrate 202 and an interface 209 may be defined between the cutting element substrate 202 and diamond table 204. The front cutting face 206 is the surface of the diamond table 204 on the side of the diamond table 204 opposite the interface 209 between the cutting element substrate 202 and the diamond table 204. In some embodiments, the lateral side surface 208 may have a generally cylindrical shape and may extend from an outer peripheral edge 211 (e.g., cutting edge) of the front cutting face 206 of the diamond table 204 to a peripheral edge of the interface 209 between the cutting element substrate 202 and the diamond table 204. Optionally, the diamond table 204 may have a chamfered edge 212 at an intersection of the front cutting face 206 and the lateral side surface 208. The chamfered edge 212 of the diamond table 204 shown in FIG. 2 has a single chamfer surface 214, although the chamfered edge 212 may have additional chamfer surfaces, and such chamfer surfaces may be oriented at chamfer angles that differ from the chamfer angle of the chamfer surface 214 as illustrated in the figures, as known in the art. In some embodiments, the cutting element substrate 202 may have a generally cylindrical shape. The diamond table 204, as noted above, may comprise a polycrystalline diamond (PCD) material in the form of a PDC.

The cutting element substrate 202 may be formed from a material that is relatively hard and resistant to wear. For example, the cutting element substrate 202 may be formed from and include a ceramic-metal composite material (which is often referred to as a "cermet" material). The cutting element substrate 202 may include a cemented carbide material, such as a cemented tungsten carbide material, in which tungsten carbide particles are cemented together in a metallic binder material. The metallic binder material may include, for example, cobalt, nickel, iron, or alloys and mixtures thereof. In some instances, the cutting element substrate 202 may comprise two or more pieces, one piece directly supporting the diamond table 204, and one or more additional pieces bonded thereto on a side of the substrate directly supporting the diamond table 204. In any case, the cutting elements 110 may be secured by their substrates 202 in pockets on blades 104 as depicted in FIG. 1, such as by brazing.

In some embodiments, the at least one recess 210 defined in the front cutting face 206 of the diamond table 204 may be located proximate the outer peripheral edge 211 of the diamond table 204. In some embodiments, the at least one recess 210 may include a plurality of recesses 210 defined in the front cutting face 206 of the diamond table 204. As shown in FIG. 2, in some embodiments, the at least one recess 210 may be oriented in a pattern such as, for example, a plurality of concentric circles. The orientation and placement of the at least one recess 210 in the front cutting face 206 of the diamond table 204 are discussed in further detail below in regard to FIGS. 5, and 6A-6E.

Figure 3:
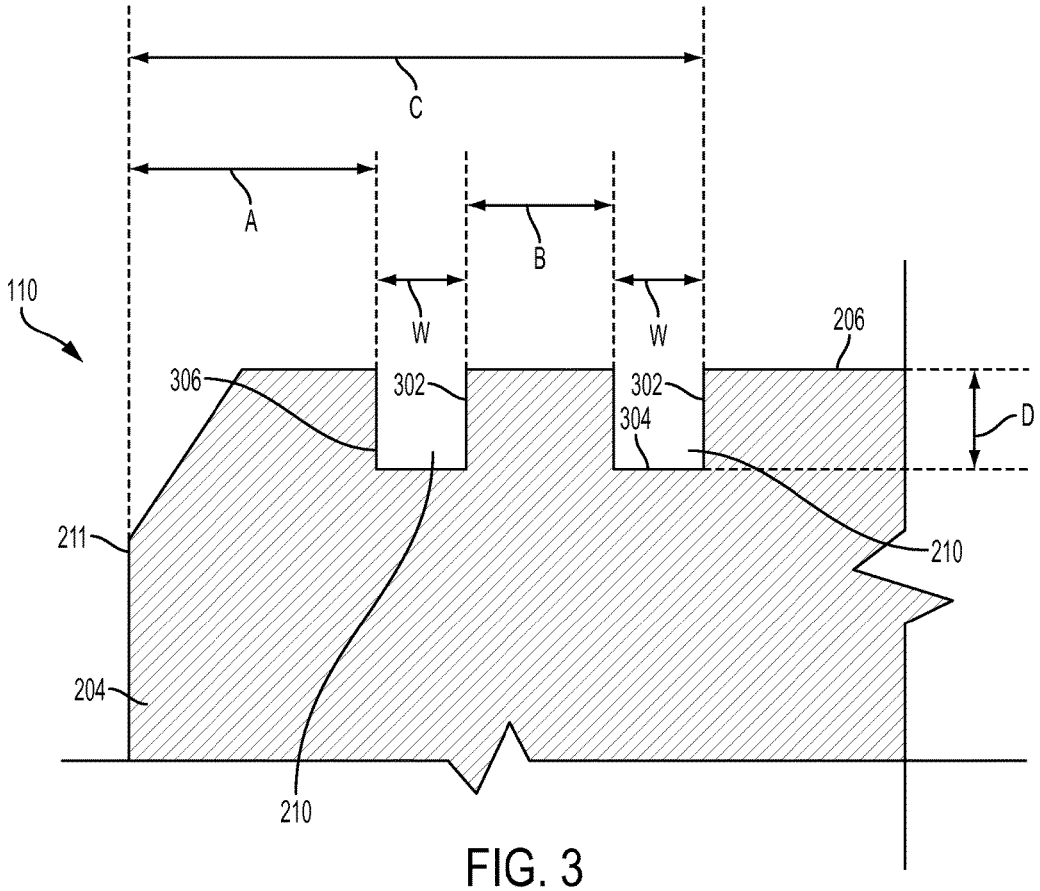
FIG. 3 is a partial cross-sectional side view of a diamond table of the cutting element of FIG. 2.

FIG. 3 is a partial cross-sectional side view of the diamond table 204 of the cutting element 110 of FIG. 2. The dimensions of the at least one recess 210 are exaggerated in order to better show the dimensions, shape, and orientation of the at least one recess 210. As shown in FIG. 3, the at least one recess 210 may include opposing sidewalls 302 and a base wall 304. Furthermore, the at least one recess 210 may have a depth D and width W. In embodiments having only one recess 210, an intersection of a radially outermost sidewall 302 of the recess 210 and the front cutting face 206 may be located some distance A from the outer peripheral edge 211 of the front cutting face 206 of the diamond table 204 when measured radially along an axis extending through a center axis of the cutting element 110 and across the front cutting face 206 of the diamond table 204. In embodiments having more than one recess 210, an intersection of a radially outermost sidewall 302 of a radially outermost recess 306 may be located some distance A from the outer peripheral edge 211 of the front cutting face 206 of the diamond table 204 when measured radially along an axis extending through a center axis of the cutting element 110 and across the front cutting face 206 of the diamond table 204. In some embodiments, the distance A may be within a range of 0.5 mm to 4.0 mm. In other embodiments, the distance A may be within a range of 0.5 mm to 2.0 mm. In other embodiments, the distance A may be within a range of 0.5 mm to 1.5 mm. For example, in some embodiments, the distance A may be within a range of 1.0 mm to 1.5 mm.

In some embodiments, the distance A may be a percentage of a diameter of the cutting element 110. For example, in some embodiments the distance A may be within a range of 4.0% to 42.0% of the diameter of the cutting element 110. For example, in some embodiments, the distance A may be within a range of 4.0% to 13.0% of the diameter of the cutting element 110. In other embodiments, A may be within a range of 12.0% to 41% of the diameter of the cutting element 110. In some embodiments, the diameter of the cutting element 110 may be within a range of 8 mm to 25 mm.

The depth D of the recess 210 may be a measurement of a length extending from the front cutting face 206 of the diamond table 204 to the base wall 304 of the at least one recess 210. In some embodiments, the at least one recess 210 may have a depth D within a range of 25.0 μm to 600 μm. In other embodiments, the at least one recess 210 may have a depth D within a range of 25.0 μm to 300 μm. In yet other embodiments, the at least one recess 210 may have a depth D within a range of 25.0 μm to 200 μm. In yet other embodiments, the at least one recess 210 may have a depth D within a range of 25.0 μm to 150 μm. In yet other embodiments, the at least one recess 210 may have a depth D within a range of 25.0 μm to 100 μm. In yet other embodiments, the at least one recess 210 may have a depth D within a range of 25.0 μm to 50 μm. In yet other embodiments, the at least one recess 210 may have a depth D within a range of 75.0 μm to 150 μm.

In some embodiments, the diamond table 204 may contain a metal catalyst used to form the diamond table with an HPHT process, as referenced above. In such embodiments, the metal catalyst may be substantially removed from a portion of the diamond table 204, such as behind the front cutting face 206, inwardly of the lateral side surface 208 of the diamond table 204, or both. In some embodiments, the at least one recess 210 may extend through an entire depth of the diamond table 204 from which catalyst has been removed, while in other embodiments, the at least one recess may be contained within the depth of substantially catalyst-free polycrystalline diamond. In other embodiments, the metal catalyst may not be substantially removed from a portion of the diamond table 204, and the at least one recess 210 may be defined in a portion of the diamond table 204 containing a metal catalyst. In embodiments where the metal catalyst has not be substantially removed from a portion of the diamond table 204, the diamond table 204 may be cooled while the at least one recess 210 is formed in the front cutting face 206 of the diamond table 204. In some embodiments, the front cutting face 206 may be cooled with a heat sink.

The width W may be a measurement of a length between a first sidewall 302 and a second opposing sidewall 302 of the at least one recess 210. In some embodiments, the at least one recess 210 may have a width W within a range of 25.0 μm to 650 μm. In other embodiments, the at least one recess 210 may have a width W within a range of 25.0 μm to 300 μm. In yet other embodiments, the at least one recess 210 may have a width W within a range of 250 μm to 200 μm. In yet other embodiments, the at least one recess 210 may have a width W within a range of 25.0 μm to 150 μm. In yet other embodiments, the at least one recess 210 may have a width W within a range of 25.0 μm to 100 μm. In yet other embodiments, the at least one recess 210 may have a width W within a range of 25.0 μm to 50 μm. In yet other embodiments, the at least one recess 210 may have a width W within a range of 100.0 μm to 200 μm. As will be appreciated by someone of ordinary skill in the art, in embodiments having more than one recess 210, the recesses 210 may have differing widths and depths relative to one another. Further, although the recesses 210 are shown as having linear walls and floors joined at sharp corners, it will be understood by those of ordinary skill in the art that such linearity and sharp definition between surfaces may not necessarily exist and are employed herein for purposes of clarity of explanation.

In embodiments having more than one recess 210, as illustrated in FIG. 3, a distance between intersections of adjacent sidewalls 302 of adjacent recesses 210 with the front cutting face 206 of the diamond table 204 may be some distance B. In some embodiments, distance B may be within a range of 0.5 mm to 4.0 mm. In other embodiments, the distance B may be within a range of 0.5 mm to 2.0 mm. In other embodiments, the distance B may be within a range of 0.5 mm to 1.0 mm.

In some embodiments, a total distance C, which may be a sum of the distance A, the widths W of the recesses 210, and any distance B between the recesses 210, may be less than 7.0 mm. In other embodiments, the total distance C may be less than 5.5 mm. In other embodiments, the total distance C may be less than 4.0 mm. In other embodiments, the total distance C may be less than 3.5 mm. In some embodiments, the total distance C may be a percentage of a diameter of the cutting element 110. For example, in some embodiments the distance C may be within a range of 12.0% to 44.0% of the diameter of the cutting element 110. For example, in some embodiments, the distance C may be within a range of 12.0% to 24.0% of the diameter of the cutting element 110. In other embodiments, C may be within a range of 38.0% to 44.0% of the diameter of the cutting element 110.

As shown in FIG. 3, surfaces of the sidewalls 302 of the at least one recess 210 may be at least generally perpendicular to the front cutting face 206 of the diamond table 204. Furthermore, the base wall 304 of the at least one recess 210 may be at least generally flat and a surface thereof may be at least generally parallel to the front cutting face 206 of the diamond table 204. Moreover, although the sidewalls 302 and base wall 304 of the at least one recess 210 are described herein as having generally flat surfaces, it is appreciated that the sidewalls 302 and base wall 304 of the at least one recess 210 may have curved, rounded, slanted, uneven, and/or irregular surfaces. In some embodiments, the width W of the at least one recess 210 may be at least substantially uniform throughout the depth D of the at least one recess 210. In other embodiments, the width W of the at least one recess 210 may decrease as the depth D of the at least one recess 210 increases. For example, at width of the base wall 304 of the recess 210 may be smaller than the width W of the at least one recess 210 at the front cutting face 206 of the diamond table 204. In some embodiments, the intersections of the base wall 304 with the sidewalls 302 may be rounded to decrease stress concentrations around the at least one recess 210. However, it is understood that in some embodiments intersections of the base wall 304 with the sidewalls 302 of the at least one recess 210 may be sharp and/or irregular.

During a drilling operation employing a cutting element 110, the at least one recess 210 in the front cutting face 206 of the diamond table 204 may be configured to mitigate shallow spall propagation in the diamond table 204 of the cutting element 110. As used herein, the terms "shallow spall" refer to spalls formed by fractures that occur at least substantially parallel to the front cutting face 206 of the diamond table 204 at about a distance of 1.0 μm to 60.0 μm from the front cutting face 206 of the diamond table 204 of the cutting element 110.

In some embodiments, the at least one recess 210 may mitigate shallow spall propagation in the diamond table 204 of the cutting element 110 by tending to cause spalls to terminate at the at least one recess 210. In other words, the at least one recess 210 may create a void of material barrier in the diamond table 204 such that when fractures in the diamond table 204 reach the at least one recess 210, the at least one recess 210 may cease propagation of the fracture, and any resulting spall may break off of the diamond table 204 at the at least one recess 210. Accordingly, in a drilling operation when the cutting element 110 is impacting earth formations, the at least one recess 210 may cause at least some resulting fractures in the diamond table 204 (e.g. breaks, cracks, chips, etc.) to cease propagating at the at least one recess 210. As a result, when the at least one recess 210 is defined proximate the outer peripheral edge 211 of the front cutting face 206 of the diamond table 204, the at least one recess 210 may help to restrict shallow spalls to occurring in the diamond table 204 at least substantially only near the outer peripheral edge 211 of the front cutting face 206 instead of at a location in the diamond table 204 radially inward from the outer peripheral edge 211 of the front cutting face 206. As discussed in further detail below, this may result in the cutting element 110 being better suited for reuse after an initial spall during a drilling operation.

In some embodiments, the at least one recess 210 may mitigate shallow spall propagation in the diamond table 204 of the cutting element 110 by suppressing (e.g., disrupting, stopping, minimizing, mitigating, etc.) surface wave (e.g., Rayleigh waves) propagation through the diamond table 204 and across the front cutting face 206 of the diamond table 204 of the cutting element 110. Surface waves, which are a type of acoustic wave that travel through solid material, can be produced by localized impacts to the solid material and can contribute to material failure (e.g., spalls). As a result, by suppressing surface wave propagation, the at least one recess 210 may mitigate shallow spalling in the diamond table 204 of the cutting element 110. Furthermore, because surface waves travel through solid materials, by having a break in geometry in the solid material at least some surface waves may be suppressed. Testing performed by the Inventors has shown that recesses 210 having depths of 50.0 μm to 100.0 μm may significantly suppress surface wave propagation. However, the testing also shows that the effect of decreasing surface wave propagation does not continue to increase at the same rate as a depth of the recess 210 increases beyond about 100.0 μm.

In some embodiments, the at least one recess 210 may sufficiently mitigate shallow spalling such that during a drilling operation an initial spall occurring in the diamond table 204 may be restricted to only a portion of the front cutting face 206 of the diamond table 204. For example, in some embodiments, the at least one recess 210 may mitigate shallow spalling such that an initial spall in diamond table 204 only extends radially inward from the outer peripheral edge 211 of the front cutting face 206 a distance of less than 6.5 mm. In other embodiments, the at least one recess 210 may mitigate shallow spalling such that an initial spall in the diamond table 204 only extends radially inward from the outer peripheral edge 211 of the front cutting face 206 a distance of less than 3.0 mm. In yet other embodiments, the at least one recess 210 may mitigate shallow spalling such that an initial spall in the diamond table 204 only extends radially inward from the outer peripheral edge 211 of the front cutting face 206 a distance of less than 2.0 mm. In yet other embodiments, the at least one recess 210 may mitigate shallow spalling such that an initial spall in the diamond table 204 only extends radially inward from the outer peripheral edge 211 of the front cutting face 206 a distance of less than 1.5 mm. In yet other embodiments, the at least one recess 210 may mitigate shallow spalling such that an initial spall in the diamond table 204 only extends radially inward from the outer peripheral edge 211 of the front cutting face 206 a distance of less than 1.1 mm. As a result, a lifespan (i.e., amount of time a cutting element 110 remains sufficiently effective during use) may be increased for a cutting element 110 by defining at least one recess 210 in the front cutting face 206 of the diamond table 204 of the cutting element 110 as described herein.

By restricting initial spalls on the front cutting face 206 of the diamond table 204 of the cutting element 110 such that the initial spalls extend radially inward from the outer peripheral edge 211 of the front cutting face 206 less than a certain distance as described herein, the cutting element 110 may be re-used. Therefore, restricting initial spalls on the front cutting face 206 of the diamond table 204 of the cutting element 110 such that the initial spalls only extend a certain distance radially inward from the outer peripheral edge 211 of the front cutting face 206 may greatly increase the reusability of cutting elements 110, which may lead to significant cost savings and an increased profit margin for users.

For example, referring to FIGS. 1 and 3 together, during a drilling operation, after an initial spall has occurred in the front cutting face 206 of the diamond table 204, the drilling operation may be stopped, and the cutting element 110 may be rotated (i.e., "spun") about its longitudinal axis within a cutting element pocket of a blade 104 in the drill bit 100. In some embodiments, the cutting element 110 may be rotated within a cutting element pocket of a blade 104 by breaking a braze bond between the cutting element 110 and the pocket of a blade 104 through heat and rotating cutting element 110 within the cutting element pocket to present an unspalled portion of the diamond table 204 for contact with a formation. In such an orientation, the cutting element 110 is again bonded the cutting element pocket of the blade 104, and the cutting element 110 may continue to be used in another drilling operation. Therefore, the cutting element 110 may be re-used such that replacing an entire cutting element 110 every time an initial spall occurs in a diamond table 204 of a cutting element 110 can be avoided.

In some embodiments, the at least one recess 210 may be formed in the front cutting face 206 of the diamond table 204 of the cutting element 110 through laser ablation. For example, material may be removed from the front cutting face 206 of the diamond table 204 by irradiating the diamond table 204 with a laser beam. In some embodiments, the material may be heated by the laser beam until the material evaporates, sublimates, or otherwise is removed from the diamond table 204. Although the at least one recess 210 is described herein as being formed through laser ablation, it will be appreciated that the at least one recess 210 could be formed through any number of methods such as, for example, drilling, cutting, milling, chemical etching, electric discharge machining (EDM), etc.

In some embodiments, after the at least one recess 210 is formed, the at least one recess 210 may be filled with a material differing from the material of the diamond table 204. For example, in some embodiments, the at least one recess 210 may be filled with silicon carbide after the at least one recess 210 is formed.

Figure 4A:
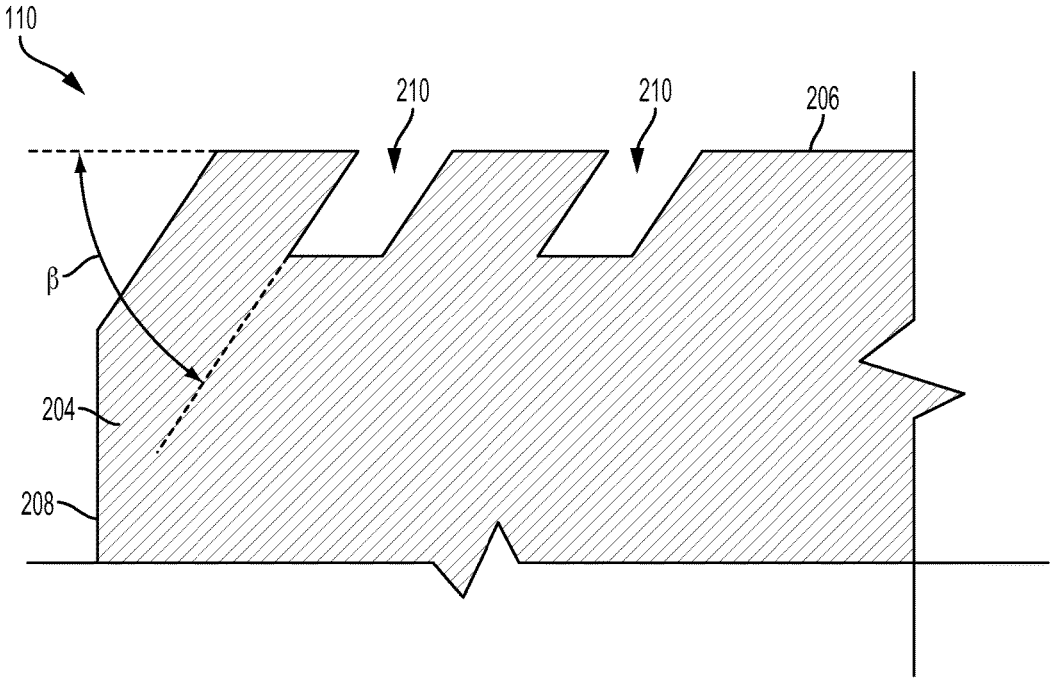
FIGS. 4A and 4B are partial cross-sectional side views of diamond tables of cutting elements according to other embodiments of the present disclosure.
Figure 4B:
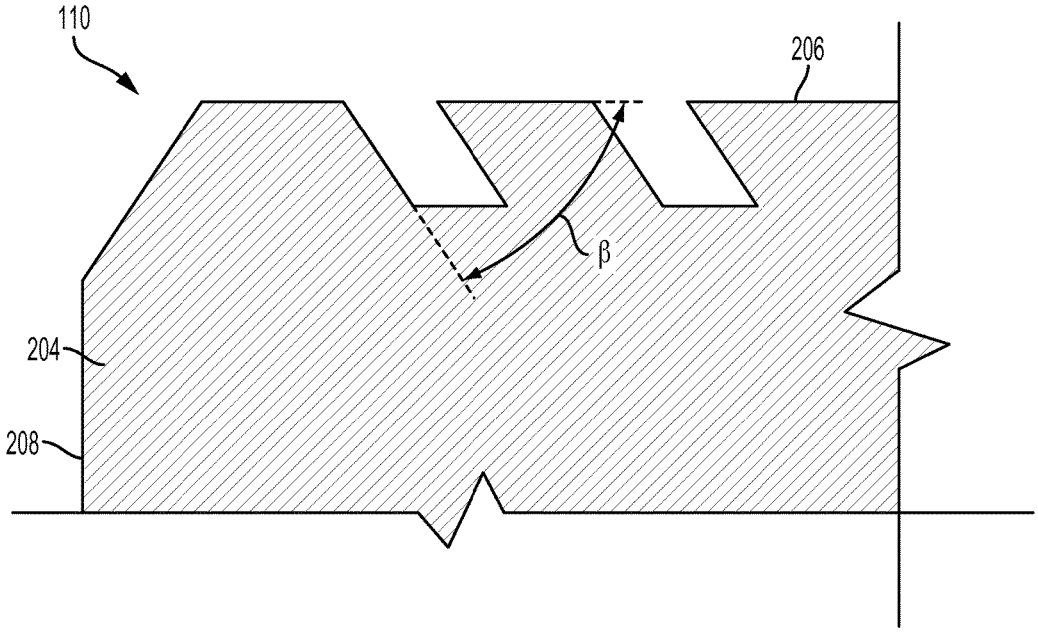

FIGS. 4A and 4B are partial cross-sectional side views of diamond tables 204 of cutting elements 110 according to other embodiments of the present disclosure. Referring to FIGS. 4A and 4B together, in some embodiments, the surfaces of the sidewalls 302 of the at least one recess 210 may be oriented at an acute angle β relative to the front cutting face 206 of the diamond table 204. The surfaces of the sidewalls 302 of the at least one recess 210 may be oriented at an acute angle relative to the front cutting face 206 in order to facilitate directing fractures to propagate in a certain direction relative to the front cutting face 206 of the diamond table 204. For example, the surfaces of the sidewalls 302 of the at least one recess 210 may be oriented at an acute angle β relative to the front cutting face 206 such that when fractures occur within the diamond table 204, the fractures are more likely to propagate toward the lateral side surface 208 or center axis of the diamond table 204 depending on the orientation of the surfaces of the sidewalls 302 of the of the at least one recess 210. In some embodiments, the surfaces of the sidewalls 302 of the of the at least one recess 210 may be oriented at an acute angle β relative to the front cutting face 206 such that when the front cutting face 206 fails the fracture propagates such that diamond table 204 self sharpens after failing.

In embodiments having more than one recess 210, the surfaces of the sidewalls 302 of a first recess 210 may be oriented at least generally perpendicular to the front cutting face 206 and the surfaces of the sidewalls 302 of a second recess 210 may be oriented at an acute angle β relative to the front cutting face 206. In other embodiments, surfaces of the sidewalls 302 of both the first recess 210 and the second recess 210 may be oriented at an acute angle β relative to the front cutting face 206.

Figure 5:
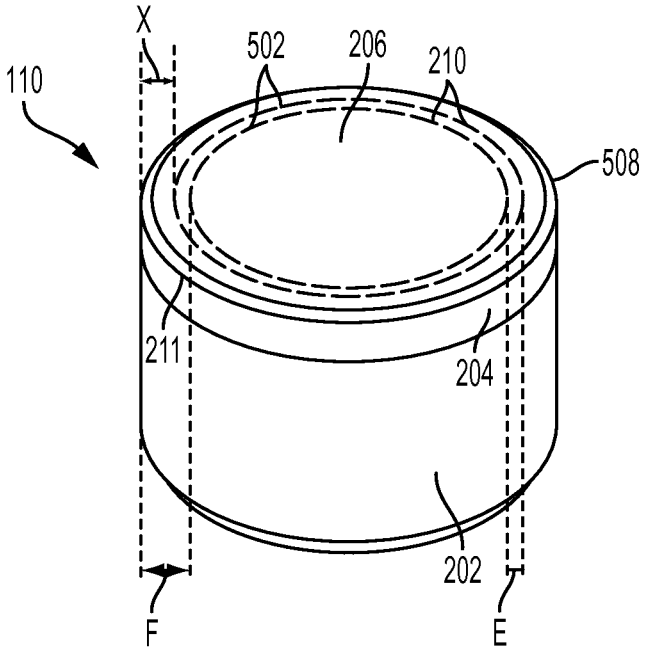
FIG. 5 is a perspective view of the cutting element of FIG. 2.

FIG. 5 is a perspective view of the cutting element 110 of FIG. 2 having a plurality of recesses 210 in the front cutting face 206 of the diamond table 204 thereof. As shown in FIG. 3, the plurality of recesses 210 in the front cutting face 206 of the diamond table 204 may form a plurality of concentric circles 502 that are concentric with a peripheral circle 508 defined by the outer peripheral edge 211 of the diamond table 204. In some embodiments, the concentric circles 502 may be segmented. In other words, each concentric circle 502 may not be continuous but may be defined by a plurality of individual recesses 210 oriented in a shape of a circle. The at least one recess 210 forming each concentric circle 502 may be segmented in order to mitigate shallow spall propagation in the diamond table 204 of the cutting element 110 while maintaining more of the structural integrity of the front cutting face 206 of the diamond table 204. In some embodiments, the concentric circles 502 may be continuous. In other words, each concentric circle 502 may be a single continuous recess 210.

In some embodiments, an intersection of a radially outermost sidewall 302 of the radially outermost concentric circle 502 and the front cutting face 206 of the diamond table 204 may be located a distance X from the outer peripheral edge 211 of the front cutting face 206 of the diamond table 204 when measured radially along an axis extending through a center axis of the cutting element 110 and across the front cutting face 206 of the diamond table 204. In some embodiments, the distance X may be within a range of 0.5 mm to 4.0 mm. In other embodiments, the distance X may be within a range of 0.5 mm to 2.0 mm. In other embodiments, the distance X may be within a range of 0.5 mm to 1.5 mm.

For example, in some embodiments, the distance X may be within a range of 1.0 mm to 1.5 mm. In some embodiments, the distance X may be a percentage of a diameter of the cutting element 110. For example, in some embodiments the distance X may be within a range of 4.0% to 42.0% of the diameter of the cutting element 110. For example, in some embodiments, the distance X may be within a range of 4.0% to 13.0% of the diameter of the cutting element 110. In other embodiments, X may be within a range of 12.0% to 41% of the diameter of the cutting element 110.

In some embodiments, a distance between intersections of adjacent sidewalls 302 of adjacent concentric circles 502 and the front cutting face 206 of the diamond table 204 may be a distance E. In some embodiments, the distance E may be within a range of 0.5 mm to 4.0 mm. In other embodiments, the distance E may be within a range of 0.5 mm to 2.0 mm. In other embodiments, the distance E may be within a range of 0.5 mm to 1.0 mm.

In some embodiments, a total distance F from the outer peripheral edge 211 of the front cutting face 206 of the diamond table 204 to a radially innermost sidewall of a radially innermost concentric circle 502 may be less than 7.0 mm. In other embodiments, the total distance F may be less than 5.5 mm. In yet other embodiments, the total distance F may be less than 4.0 mm. In other embodiments, the total distance F may be less than 3.5 mm.

In some embodiments, the total distance F may be a percentage of a diameter of the cutting element 110. For example, in some embodiments the distance F may be within a range of 12.0% to 44.0% of the diameter of the cutting element 110. For example, in some embodiments, the distance F may be within a range of 12.0% to 24.0% of the diameter of the cutting element 110. In other embodiments, F may be within a range of 38.0% to 44.0% of the diameter of the cutting element 110.

In some embodiments, the outermost concentric circle 502 may be segmented and at least one inner concentric circle 502 may be continuous. In other embodiments, the outermost concentric circle 502 may be continuous and at least one inner circle may be segmented. It will be appreciated by one of ordinary skill in the art that in some embodiments, the front cutting face 206 of the diamond table 204 may include only one circle defined by the at least one recess 210, and the only one circle may be concentric with the peripheral circle 508 defined by the outer peripheral edge 211 of the diamond table 204.

Figure 6A:
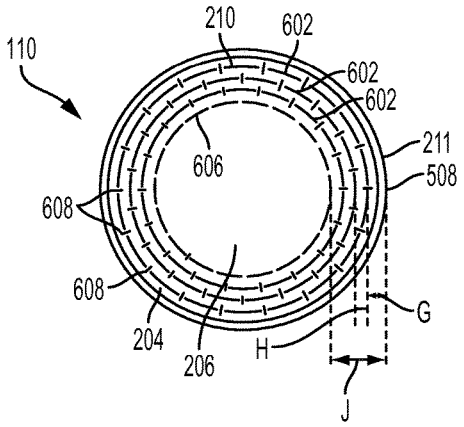
FIGS. 6A-6E are top views of front cutting faces of diamond tables having recesses defined thereon according to other embodiments of the present disclosure.

FIGS. 6A-6E are top views of front cutting faces of diamond tables 204 of cutting elements 110 having at least one recess 210 therein according to other embodiments of the present disclosure. Referring to FIG. 6A, in some embodiments, the front cutting face 206 of the diamond table 204 of the cutting element 110 may include a plurality of recesses 210 oriented in a plurality of segmented concentric circles 602 that are concentric to the peripheral circle 508 defined by the outer peripheral edge 211 of the front cutting face 206 of the diamond table 204. Each recess of the plurality of recesses 210 forming the plurality of segmented concentric circles 602 may have a longitudinal length that is aligned with a shape of a respective circle of which the recess is forming. In some embodiments, an additional recess 608 may be defined between adjacent recesses 210 of the plurality of recesses 210 forming the plurality of segmented concentric circles 602. Each additional recess 608 may have a longitudinal length that is at least substantially perpendicular to the longitudinal lengths of the adjacent recesses 210 between which each additional recess 608 is oriented. In some embodiments, the front cutting face 206 of the diamond table 204 may further include a radially innermost concentric circle 606 relative to the segmented concentric circles 602 formed by the plurality of recesses 210.

In some embodiments, an intersection of a radially outermost sidewall 302 of a radially outermost segmented concentric circle of the plurality of segmented concentric circles 602 and the front cutting face 206 of the diamond table 204 may be located some distance G from the outer peripheral edge 211 of the front cutting face 206 of the diamond table 204 when measured radially along an axis extending through a center axis of the cutting element 110 and across the front cutting face 206 of the diamond table 204. In some embodiments, the distance G may be within a range of 0.5 mm to 4.0 mm. In other embodiments, the distance G may be within a range of 0.5 mm to 2.0 mm. In other embodiments, the distance G may be within a range of 0.5 mm to 1.5 mm. For example, in some embodiments, the distance G may be within a range of 1.0 mm to 1.5 mm.

A distance between intersections of adjacent sidewalls 302 of adjacent segmented concentric circles 602 with the front cutting face 206 may be some distance H. In some embodiments, distance H may be within a range of 0.5 mm to 4.0 mm. In other embodiments, the distance H may be within a range of 0.5 mm to 2.0 mm. In other embodiments, the distance H may be within a range of 0.5 mm to 1.0 mm.

In some embodiments, a total distance J, which may be a distance between the outer peripheral edge 211 of the front cutting face 206 and an intersection of the radially innermost sidewall of the radially innermost concentric circle 606 with the front cutting face 206, may be less than 7.0 mm. In other embodiments, the total distance J may be less than 5.5 mm. In yet other embodiments, the total distance J may be less than 4.0 mm. In other embodiments, the total distance J may be less than 3.5 mm. In some embodiments, the total distance J may be a percentage of a diameter of the cutting element 110. For example, in some embodiments the distance J may be within a range of 12.0% to 44.0% of the diameter of the cutting element 110. For example, in some embodiments, the distance J may be within a range of 12.0% to 24.0% of the diameter of the cutting element 110. In other embodiments, J may be within a range of 38.0% to 44.0% of the diameter of the cutting element 110.

Figure 6B:
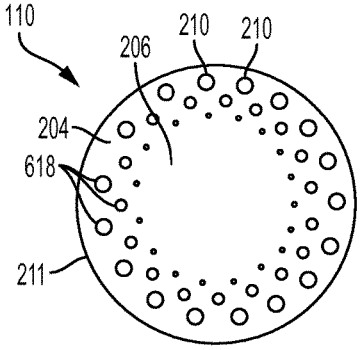

Referring to FIG. 6B, in some embodiments, the front cutting face 206 of the diamond table 204 of the cutting element 110 may include a plurality of recesses 210, wherein each recess 210 of the plurality of recesses 210 forms a respective circle of a plurality of circles 618. The plurality of circles 618 may be oriented adjacent to each other and generally proximate the outer peripheral edge 211 of the front cutting face 206 of the diamond table 204. In some embodiments, a diameter of the plurality of circles 618 may vary in size. For example, in some embodiments, a group of circles 618 most proximate the outer peripheral edge 211 of the front cutting face 206 of the diamond table 204 may have a larger diameter than a group of circles 618 that is less proximate the outer peripheral edge 211 of the front cutting face 206. In some embodiments, the plurality of circles 618 may be located within a range of distances from the outer peripheral edge 211 of the front cutting face 206 when measured radially along an axis extending through a center axis of the cutting element 110 and across the front cutting face 206 of the diamond table 204. For example, in some embodiments, the plurality of circles 618 may be located within a range of 1.0 mm to 6.5 mm from the outer peripheral edge 211 of the front cutting face 206. In some embodiments, the plurality of circles 618 may be located within a range of 1.0 mm to 4.5 mm from the outer peripheral edge 211 of the front cutting face 206. In some embodiments, the plurality of circles 618 may be located within a range of 1.0 mm to 3.5 mm from the outer peripheral edge 211 of the front cutting face 206.

Figure 6C:
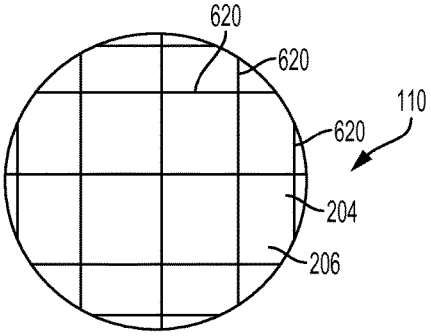

Referring to FIG. 6C, in some embodiments, the front cutting face 206 of the diamond table 204 of the cutting element 110 may include a plurality of linear recesses 620 that are oriented in a grid 622 across the front cutting face 206. In some embodiments, the plurality of linear recesses 620 may be segmented. In other embodiments, the plurality of linear recesses 620 may be continuous. In some embodiments, some of the plurality of linear recesses 620 may be segmented and some of the linear recesses 620 may be continuous.

Figure 6D:
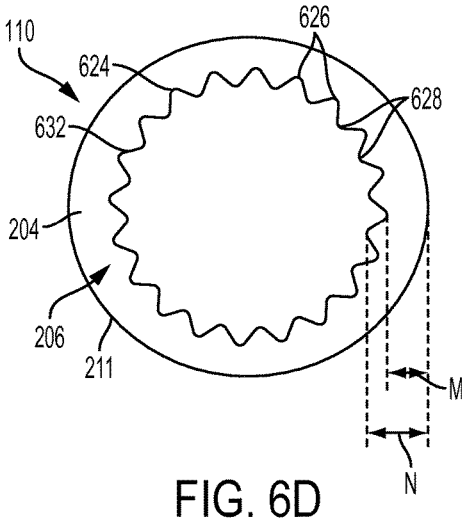

Referring to FIG. 6D, in some embodiments, the front cutting face 206 of the diamond table 204 of the cutting element 110 may include a sinusoidal-wave-shaped recess 624 that extends along an outer peripheral portion 632 of the front cutting face 206 of the diamond table 204 proximate the outer peripheral edge 211 of the front cutting face 206 of the diamond table 204. In some embodiments, intersections of a radially outermost sidewall 302 of the sinusoidal-wave-shaped recess 624 with the front cutting face 206 of the diamond table 204 at crests 626 of the sinusoidal-wave-shaped recess 624 may be some distance M from the outer peripheral edge 211 of the front cutting face 206 when measured radially along an axis extending through a center axis of the cutting element 110 and across the front cutting face 206 of the diamond table 204. In some embodiments, the distance M may be within a range of 0.5 mm to 4.0 mm. In other embodiments, the distance M may be within a range of 0.5 mm to 2.0 mm. In other embodiments, the distance M may be within a range of 0.5 mm to 1.5 mm. For example, in some embodiments, the distance M may be within a range of 1.0 mm to 1.5 mm.

In some embodiments, intersections of a radially innermost sidewall of the sinusoidal-wave-shaped recess 624 with the front cutting face 206 of the diamond table 204 at troughs 628 of the sinusoidal-wave-shaped recess 624 may be some distance N from the outer peripheral edge 211 of the front cutting face 206 when measured radially along an axis extending through a center axis of the cutting element 110 and across the front cutting face 206 of the diamond table 204. In some embodiments, the distance N may be less than 7.0 mm. In other embodiments, the distance N may be less than 5.5 mm. In other embodiments, the distance N may be less than 4.0 mm. In other embodiments, the distance N may be less than 3.5 mm.

In some embodiments, the front cutting face 206 of the diamond table 204 of the cutting element 110 may include two or more concentric the sinusoidal-wave-shaped recesses 624. In some embodiments, the sinusoidal-wave-shaped recess 624 or recesses 210 may be segmented. In some embodiments, the sinusoidal-wave-shaped recess 624 or recesses 210 may be continuous. In some embodiments having two or more concentric the sinusoidal-wave-shaped recesses 624, a first sinusoidal-wave-shaped recess 624 may be segmented and a second sinusoidal-wave-shaped recess 624 may be continuous.

Figure 6E:
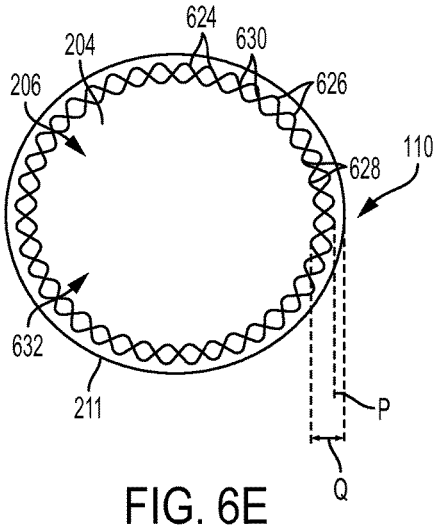

Referring to FIG. 6E, in some embodiments, the front cutting face 206 of the diamond table 204 of the cutting element 110 may include two intersecting sinusoidal-wave-shaped recesses 624 that extend along the outer peripheral portion 632 of the front cutting face 206 of the diamond table 204 proximate the outer peripheral edge 211 of the front cutting face 206 of the diamond table 204. The two intersecting sinusoidal-wave-shaped recesses 624 may intersect at nodes 630 of the two intersecting sinusoidal-wave-shaped recesses 624. In some embodiments, intersections of radially outermost sidewalls 302 of the two intersecting sinusoidal-wave-shaped recesses 624 with the front cutting face 206 of the diamond table 204 at crests 626 of two intersecting sinusoidal-wave-shaped recesses 624 may be some distance P from the outer peripheral edge 211 of the front cutting face 206 when measured radially along an axis extending through a center axis of the cutting element 110 and across the front cutting face 206 of the diamond table 204. In some embodiments, the distance P may be within a range of 0.5 mm to 4.0 mm. In other embodiments, the distance P may be within a range of 0.5 mm to 2.0 mm. In other embodiments, the distance P may be within a range of 0.5 mm to 1.5 mm. For example, in some embodiments, the distance P may be within a range of 1.0 mm to 1.5 mm.

In some embodiments, intersections of radially innermost sidewalls 302 of the two intersecting sinusoidal-wave-shaped recesses 624 with the front cutting face 206 of the diamond table 204 at troughs 628 of the two intersecting sinusoidal-wave-shaped recesses 624 may be some distance Q from the outer peripheral edge 211 of the front cutting face 206 when measured radially along an axis extending through a center axis of the cutting element 110 and across the front cutting face 206 of the diamond table 204. In some embodiments, the distance Q may be less than 7.0 mm. In other embodiments, the distance Q may be less than 5.5 mm. In other embodiments, the distance Q may be less than 4.0 mm. In other embodiments, the distance Q may be less than 3.5 mm.

Although the at least one recess 210 is described herein as having the above described shapes and orientations, it is understood that the at least one recess 210 may include any geometric shaped recess. For example, the at least one recess 210 may include at least one recess in a shape of a rectangle, triangle, oval, arc, hexagon, octagon, etc. Furthermore, the at least one recess 210 may include at least one recess forming only a portion of a rectangle, triangle, oval, arc, hexagon, octagon, etc.

Figure 7A:
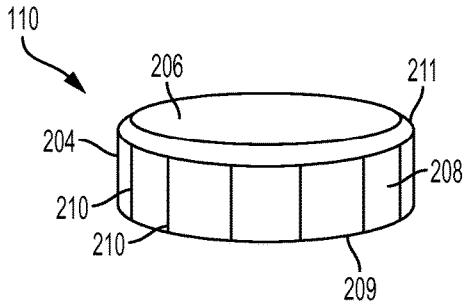
FIGS. 7A-7F are perspective views of diamond tables of cutting elements having recesses defined on a lateral side surface thereof according to other embodiments of the present disclosure.

FIGS. 7A-7F are perspective views of diamond tables 204 of cutting elements 110 according to other embodiments of the present disclosure. Referring to FIG. 7A, in some embodiments of the present disclosure, at least one recess 210 may be defined in the lateral side surface 208 of the diamond table 204. In some embodiments, a plurality of recesses 210 may be defined in the lateral side surface 208. In some embodiments, the longitudinal lengths of the plurality of recesses 210 may be oriented at least substantially parallel to each other and to a longitudinal length of the cutting element 110. In other words, the longitudinal lengths of the plurality of recesses 210 may be oriented at least substantially perpendicular to the front cutting face 206 of the diamond table 204. In some embodiments, the plurality of recesses 210 may be at least substantially evenly spaced apart along the lateral side surface 208 of the diamond table 204. In some embodiments, the plurality of recesses 210 may extend from the outer peripheral edge 211 of the front cutting face 206 of the diamond table 204 to the interface 209 between the diamond table 204 and cutting element substrate 202. In other embodiments, the plurality of recesses 210 may only extend along a portion of lateral side surface 208 instead of extending from the outer peripheral edge 211 of the front cutting face of the diamond table 204 to the interface 209 between the diamond table 204 and cutting element substrate 202.

In some embodiments, the at least one recess 210 in the lateral side surface 208 of the diamond table 204 may be configured to mitigate failures (e.g., spalling, cracks, chips, breaks, etc.) in the lateral side surface 208 of the diamond table 204 of the cutting element 110 during use in a drilling operation. In some embodiments, the at least one recess 210 may mitigate fractures in the lateral side surface 208 of the diamond table 204 of the cutting element 110 by tending to cause failures to terminate at the at least one recess 210. In other words, the at least one recess 210 may create a void of material barrier in the diamond table 204 such that when fractures in the diamond table 204 reach the at least one recess 210, the at least one recess 210 may cease propagation of the fracture, and any resulting chip may break off of the diamond table 204 at the at least one recess 210. As a result, when the lateral side surface 208 includes a plurality of recesses 210 oriented parallel to each other, the plurality of recesses 210 may help to restrict fractures to occurring on the lateral side surface 208 within spaces between adjacent recesses 210 of the plurality of recesses 210 instead of propagating throughout the diamond table 204 beyond the adjacent recesses 210. In other words, if the lateral side surface 208 fractures, wherein the fracture begins between two adjacent recesses 210, the fracture may be at least partially kept between the two adjacent recesses 210. In some embodiments, the at least one recess 210 may mitigate failures across the lateral side surface 208 of the diamond table 204 of the cutting element 110 by suppressing (e.g., disrupting, stopping, minimizing, etc.) Surface wave propagation in the diamond table 204 and across the lateral side surface 208 of the diamond table 204 of the cutting element 110.

In some embodiments, the plurality of recesses 210 may be segmented. In other embodiments, the plurality of recesses 210 may be continuous. In yet other embodiments, some of the plurality of recesses 210 may be segmented and some of the plurality of recesses 210 may be continuous.

Figure 7B:
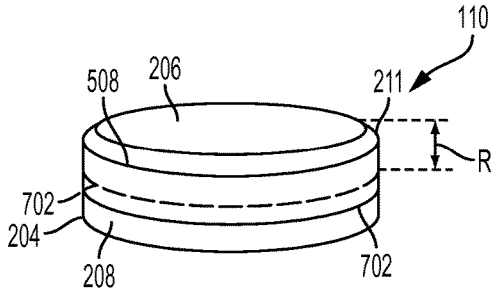
Figure 7C:
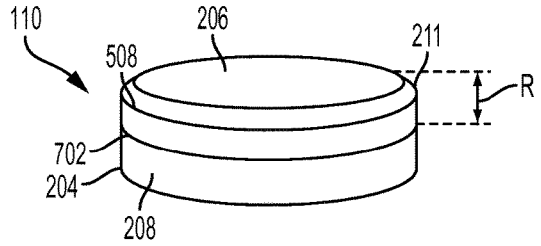

Referring to FIGS. 7B and 7C together, in some embodiments of the present disclosure, at least one linear recess 702 may be defined along the lateral side surface 208 of the diamond table 204, and a longitudinal length of the at least one linear recess 702 may be at least substantially parallel to the front cutting face 206 of the diamond table 204. In other words, the longitudinal length of the at least one linear recess 702 may be parallel to the peripheral circle 508 defined by the outer peripheral edge 211 of the front cutting face 206 of the diamond table 204. In some embodiments, an intersection of an axially uppermost sidewall of the at least one linear recess 702 (when viewed from the perspective depicted in FIGS. 7B and 7C relative to a surface upon which the diamond table 204 may be place) with the lateral side surface 208 may be located some distance R from the front cutting face 206 when measured axially from the front cutting face 206. In some embodiments, the distance R may be within a range of 0.2 mm to 4.5 mm. In other embodiments, the distance R may be within a range of 0.5 mm to 2.0 mm. In other embodiments, the distance R may be within a range of 0.5 mm to 1.5 mm. For example, in some embodiments, the distance R may be within a range of 1.0 mm to 1.5 mm.

As a result, when the at least one linear recess 702 is defined proximate the front cutting face 206 of the diamond table 204 on the lateral side surface 208 of the diamond table 204, the at least one linear recess 702 may help to restrict failures to occurring on the lateral side surface 208 at least substantially only near the front cutting face 206. In other words, the at least one linear recess 702 may help keep fractures from propagating from the front cutting face 206 to a location axially beyond the at least one linear recess 702 on the lateral side surface 208. In some embodiments the at least one linear recess 702 may be continuous as shown in FIG. 7C. In other embodiments, the at least one linear recess 702 may be segmented as shown in FIG. 7B. In some embodiments, the lateral side surface 208 may include a plurality of parallel linear recesses 702, as shown in FIG. 7B.

Figure 7D:
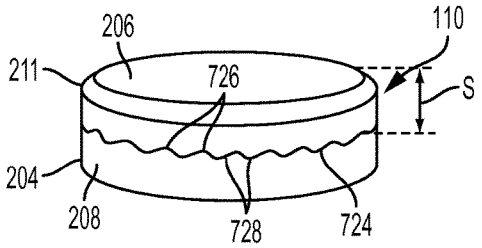
Figure 7E:
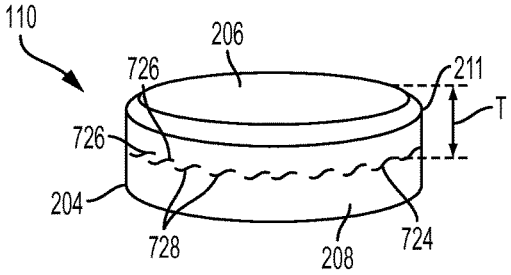

Referring to FIGS. 7D and 7E together, in some embodiments of the present disclosure, the lateral side surface 208 of the diamond table 204 may include a sinusoidal-wave-shaped recess 724. In some embodiments, an intersection of an axially uppermost sidewall of the sinusoidal-wave-shaped recess 724 (when viewed from the perspective depicted in FIGS. 7D and 7E relative to a surface upon which the diamond table 204 may be place) with the lateral side surface 208 at crests 726 of the sinusoidal-wave-shaped recess 724 may be located some distance S from the front cutting face 206 when measured axially from the front cutting face 206. In some embodiments, the distance S may be within a range of 0.2 mm to 4.5 mm. In other embodiments, the distance S may be within a range of 0.5 mm to 2.0 mm. In other embodiments, the distance S may be within a range of 0.5 mm to 1.5 mm. For example, in some embodiments, the distance S may be within a range of 1.0 mm to 1.5 mm.

In some embodiments, an intersection of an axially lowermost sidewall of the sinusoidal-wave-shaped recess 724 (when viewed from the perspective depicted in FIGS. 7D and 7E relative to a surface upon which the diamond table 204 may be place) with the lateral side surface 208 at troughs 728 of the sinusoidal-wave-shaped recess 724 may be located some distance T from the front cutting face 206 when measured axially from the front cutting face 206. In some embodiments, the distance T may be less than 7.5 mm. In other embodiments, the distance T may be less than 5.5 mm. In other embodiments, the distance T may be less than 4.0 mm. In other embodiments, the distance T may be less than 3.5 mm.

Figure 7F:
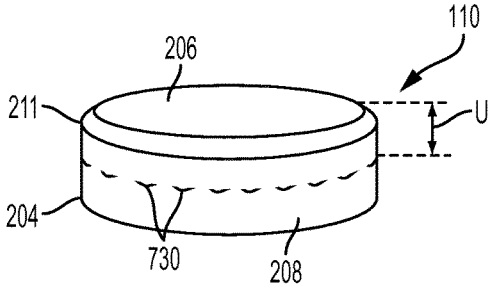

Referring to FIG. 7F, in some embodiments of the present disclosure, the lateral side surface 208 of the diamond table 204 may include a plurality of arc recesses 730 oriented next to each other in a linear fashion. In some embodiments, intersections of axially uppermost sidewalls 302 of uppermost portions of the arc recesses 730 (when viewed from the perspective depicted in FIG. 7F relative to a surface upon which the diamond table 204 may be place) and the lateral side surface 208 may be located some distance U from the front cutting face 206 when measured axially from the front cutting face 206. In some embodiments, the distance U may be within a range of 0.2 mm to 4.5 mm. In other embodiments, the distance U may be within a range of 0.5 mm to 2.0 mm. In other embodiments, the distance U may be within a range of 0.5 mm to 1.5 mm. For example, in some embodiments, the distance U may be within a range of 1.0 mm to 1.5 mm. In some embodiments, the plurality of arc recesses 730 may include a plurality of partial arc recesses.

Referring to FIGS. 5 and 7A-7F together, in some embodiments, at least one recess 210 may be defined in both a front cutting face 206 of a diamond table 204 and in a lateral side surface 208 of a diamond table 204.

Referring again to FIGS. 1 and 2, in some embodiments at least one recess 210 may be defined in a front cutting face 206 of a diamond table 204 of a polished cutter element. As used herein, the term "polished," when used to describe a condition of a surface of a volume of superabrasive material or a substrate of a cutting element 110, means that the polished element has a surface finish roughness less than about 10 μin. (about 0.254 μm) root mean square (RMS). Surface waves may propagate through polished surfaces with a greater intensity than in non-polished surfaces. Therefore, defining at least one recess 210 in a front cutting face 206 of a polished diamond table 204 may help to mitigate shallow spalling in the front cutting face 206 of the polished diamond table 204.

In some embodiments, at least one recess 210 may be defined in the chamfer of the diamond table 204 and may help to mitigate failures (e.g., spalls, cracks, chips, etc.) in the chamfer of the diamond table 204 of a cutting element 110.

Embodiments of cutting elements of the present disclosure may be used to attain one or more of the advantages described above.

Although the foregoing description contains many specifics, these are not to be construed as limiting the scope of the present disclosure, but merely as providing certain example embodiments. Similarly, other embodiments of the disclosure may be devised which are within the scope of the present disclosure. For example, features described herein with reference to one embodiment may also be combined with features of other embodiments described herein. The scope of the disclosure is, therefore, indicated and limited only by the appended claims, rather than by the foregoing description. All additions, deletions, and modifications to the devices, apparatuses, systems and methods, as disclosed herein, which fall within the meaning and scope of the claims, are encompassed by the present disclosure.

What is claimed is:

1. A cutting element, comprising:

a diamond table having a front cutting face, the cutting face having an outer peripheral edge;

at least one recess defined on the front cutting face of the diamond table and comprising:

sidewalls intersecting with the front cutting face of the diamond table and extending to a base wall within the diamond table, wherein a sidewall of the at least one recess most proximate the outer peripheral edge of the front cutting face is sinusoidal-wave-shaped; and wherein an intersection of a sidewall of the at least one recess and the front cutting face of the diamond table most proximate the outer peripheral edge of the front cutting face is located a distance of 0.5 mm to 4.0 mm from the outer peripheral edge of the front cutting face of the diamond table and wherein the at least one recess has a width within a range of 25.0 μm to 650 μm and a depth within a range of 25.0 μm to 600 μm.

2. The cutting element of claim 1, wherein the at least one recess has a width within the range of 50.0 μm to 650 μm and a depth within a range of 50.0 μm to 600 μm.

3. The cutting element of claim 1, wherein the at least one recess has a width within the range of 100 μm to 200 μm and a depth within a range of 75.0 μm to 155 μm.

4. The cutting element of claim 1, wherein the intersection of the sidewall of the at least one recess and front cutting face of the diamond table most proximate the outer peripheral edge is located a distance of 1.0 mm to 3.0 mm from the outer peripheral edge of the front cutting face of the diamond table.

5. The cutting element of claim 1, wherein the diamond table further comprises at least substantially cylindrical lateral side surface having at least one recess defined thereon.

6. The cutting element of claim 1, wherein the at least one recess comprises at least one circular recess on the front cutting face of the diamond table.

7. The cutting element of claim 1, wherein the at least one recess comprises a plurality of concentric, circular recesses that are concentric to a peripheral circle defined by an outer peripheral edge of the front cutting face of the diamond table.

8. The cutting element of claim 1, wherein the sidewalls of the at least one recess are oriented at an acute angle relative to the front cutting face of the diamond table.

9. The cutting element of claim 1, wherein the base wall of the at least one recess is at least generally flat and parallel to the front cutting face of the diamond table.

10. An earth-boring tool, comprising:

a bit body; and at least one cutting element secured to the bit body and comprising:

a diamond table having a front cutting face, the cutting face having an outer peripheral edge;

a plurality of recesses formed in the front cutting face of the diamond table, the plurality of recesses collectively forming a segmented circle in the front cutting face, each recess of the plurality of recesses comprising:

sidewalls intersecting with the front cutting face of the diamond table and extending to a base wall within the diamond table; and wherein an intersection of a sidewall of the at least one recess and the front cutting face of the diamond table most proximate the outer peripheral edge of the front cutting face is located a distance of 0.5 mm to 4.0 mm from the outer peripheral edge of the front cutting face of the diamond table and wherein the at least one recess has a width within a range of 25.0 μm to 650 μm and a depth within a range of 25.0 μm to 600 μm.

11. The earth-boring tool of claim 10, wherein each recess of the plurality of recesses has a width within a range of 50.0 μm to 650 μm and a depth within a range of 50.0 μm to 600 μm.

12. The earth-boring tool of claim 10, wherein each recess of the plurality of recesses has a width within a range of 100.0 μm to 200 μm and a depth within a range of 75.0 μm to 155 μm.

13. The earth-boring tool of claim 10, wherein the intersection of the sidewall of at least one recess of the plurality of recesses and front cutting face of the diamond table most proximate the outer peripheral edge is located a distance of 1.0 mm to 3.0 mm from the outer peripheral edge of the front cutting face of the diamond table.

14. The earth-boring tool of claim 10, wherein the intersection of the sidewall of at least one recess of the plurality of recesses and front cutting face of the diamond table most proximate the outer peripheral edge is located a distance of 1.0 mm to 1.5 mm from the outer peripheral edge of the front cutting face of the diamond table.

15. The earth-boring tool of claim 10, wherein the intersection of the sidewall of at least one recess of the plurality of recesses and front cutting face of the diamond table most proximate the outer peripheral edge is located a distance of 4.0% to 42.0% of a diameter of the at least one cutting element from the outer peripheral edge of the front cutting face of the diamond table.

16. The earth-boring tool of claim 10, wherein the diamond table of the at least one cutting element further comprises at least substantially cylindrical lateral side surface having at least one recess defined thereon.

17. The earth-boring tool of claim 16, wherein the at least one recess defined on the at least substantially cylindrical lateral side surface of the diamond table comprises a sinusoidal-wave-shaped recess.

18. A method of reusing a cutting element configured to mitigate spalling, the method comprising:

inserting a cutting element into a pocket of a drill bit, the cutting element comprising a diamond table having a front cutting face and having a plurality of recesses formed in the front cutting face of the diamond table, the plurality of recesses collectively forming a segmented circle in the front cutting face, each recess of the plurality of recesses having a depth of 25.0 μm to 600 μm and a width of 25.0 μm to 650 μm cutting face;

after performance of a drilling operation with the drill bit and after an occurrence of an initial spall in the diamond table of the cutting element, rotating the cutting element about a longitudinal axis thereof within the pocket to present an unspalled area of the front cutting face for drilling; and performing another drilling operation with the cutting element in the drill bit.

19. The method of claim 18, wherein each recess of the plurality of recesses has a depth of 50.0 μm to 600 μm and a width of 25.0 μm to 650 μm.

* * * * *